United States Patent [19]

De Kok

[11] 4,052,634

[45] Oct. 4, 1977

[54] HIGH-PRESSURE GAS DISCHARGE LAMP AND ELECTRON EMISSIVE ELECTRODE STRUCTURE THEREFOR

[75] Inventor: Johannis De Kok, Eindhoven, Netherlands

[73] Assignee: U.S. Philips Corporation, New York, N.Y.

[21] Appl. No.: 697,148

[22] Filed: June 17, 1976

[30] Foreign Application Priority Data

June 20, 1975 Netherlands ..... 7507356

[51] Int. Cl.[2] ..... H01J 1/14; H01J 61/073; H01J 61/20

[52] U.S. Cl. ..... 313/184; 313/213; 313/218; 313/229; 313/346 R; 29/25.14

[58] Field of Search ..... 313/218, 346 R, 229, 313/184, 213; 29/25.14

[56] References Cited

U.S. PATENT DOCUMENTS 3,708,710 1/1973 Smyser et al. ..... 313/213

3,919,581 11/1975 Datta ..... 313/346 R X 3,988,629 10/1976 White et al. ..... 313/218 X

FOREIGN PATENT DOCUMENTS 252,476 2/1970 U.S.S.R. ..... 313/218

*Primary Examiner*—Palmer C. Demeo

*Attorney, Agent, or Firm*—Frank R. Trifari; Robert S. Smith

[57] ABSTRACT

A high-pressure gas discharge lamp having an electrode consisting of a support of a high-melting metal provided with an electron emissive material. The emissive material consists mainly of one or more oxidic compounds containing (a) at least one of the rare earth metal oxides, (b) alkaline earth metal oxide in a quantity of 0.66 to 4 mole per mole of rare earth oxide and (c) at least one of the oxides of tungsten and molybdenum in a quantity of 0.25 to 0.40 mole per mole of alkaline earth metal oxide, the alkaline earth metal oxide consisting of at least 25 mol.% of barium oxide.

7 Claims, 3 Drawing Figures

HIGH-PRESSURE GAS DISCHARGE LAMP AND ELECTRON EMISSIVE ELECTRODE STRUCTURE THEREFOR

The invention relates to a high-pressure gas discharge lamp having an electrode provided with an electron-emitting material. The invention relates particularly to high-pressure mercury vapour- and high-pressure sodium vapour discharge lamps having such an electrode. The invention also relates to a method for producing such high-pressure gas discharge lamps.

In gas discharge lamps thermionic emitting electrodes are generally used which consist of a support of high-melting metal provided with an electron emitting material. This material, also called emitter, emits electrons more readily than the material of the support itself. The use of an emitter yields the advantages of a lower starting voltage of the lamp and of lower electrode losses during operation of the lamp.

Commonly known emitters are barium oxide and mixtures of barium oxide with one or more of the other alkaline earth metal oxides strontium oxide and calcium oxide. These emitters are frequently used in low pressure gas discharge lamps. However, in high pressure gas discharge lamps they cannot be used because they sputter, owing to the stronger ion bombardment occurring in these lamps and because they evaporate to a great extent owing to the high operating temperature of the electrode in these lamps. For use in low-pressure gas discharge lamps emitters have been proposed (see British patent specification No. 472,648) on the basis of zirconium oxide, to which small quantities of yttrium oxide or rare earth metal oxide and, possibly, thorium oxide and alkaline earth metal oxide have been added. However, in high-pressure gas discharge lamps these emitters prove not to be satisfactory.

Known emitters suitable for high pressure gas discharge lamps (see U.S. Pat. No. 3,708,710) are alkaline earth tungstates which are given by the formula $Me_3WO_6$, in which Me represents barium or mixtures of barium with other alkaline earth metals and in which slight deviations from the stoichiometry of this formula are possible. Substances having the structure of $Ba_2CaWO_6$ have particularly favourable properties. A disadvantage of these tungstates which indeed lead to a desired low starting voltage of the lamp is that they have emission properties which are not so good during operation of the lamp. In order to improve this these tungstate emitters are used in practice together with thorium oxide, of which it is known that it is an excellent emitter at high temperatures. In general the emitter then contains from 1 to 2 mole $ThO_2$ per mole of tungstate. Comparable emission properties can be obtained with molybdates which are analogous to the above described tungstates, namely compounds which are represented by the formula $Me_3MoO_6$. Optimum emission properties during operation of the lamp are again obtained by using these molybdates in combination with thorium oxide.

In high-pressure gas discharge lamps which are filled with a particularly agressive gas, for example high-pressure mercury vapour discharge lamps which contain, besides mercury, one or more metal halides, emitters which contain alkaline earth metal oxide or alkaline earth compounds cannot be used as these emitters are attacked by the halogens or halides. For such lamps one is limited to the use of thorium oxide as an emitter.

Dutch Patent Application 69.03692 describes also the use of rare earth metal oxides as an emitter in such lamps. However, it has appeared that these lamps start only at relatively high voltages.

Emissive materials which contain thorium or thorium oxide have the great disadvantage that they are radioactive so that their use and processing entails many medical and environmental-hygienical objections.

This invention has for its object to provide a high-pressure gas discharge lamp having an electrode provided with an emissive material which yields the same favourable starting properties as the alkaline earth metal tungstate or molybdate emitters. At the same time the emission properties during operation of the lamp must be improved while the use of thorium or thorium oxide is avoided.

A high-pressure gas discharge lamp according to the invention possesses a radiation-transmissive envelope which contains electrodes and an ionizable medium in which the discharge is maintained, wherein at least one of the electrodes consists of a support of a high-melting metal provided with an electron emitting material which contains an alkaline earth metal and at least one of the metals tungsten and molybdenum and is characterized in that the electron emitting material consist mainly of at least one oxidic compound containing at least one of the rare earth metal oxides, alkaline earth metal oxide in a quantity of 0.66 to 4 mole per mole of rare earth metal oxide and at least one of the oxides of tungsten and molybdenum in a quantity of 0.25 to 0.40 mole per mole of alkaline earth metal oxide, the alkaline earth metal oxide consisting for at least 25 mol% of barium oxide.

The envelope of a lamp according to the invention may consist of a glass having a high $SiO_2$- content, of quartz glass or of aluminium oxide, either in densely sintered form or in crystalline form. Within the envelope there are an ionizable medium and generally two electrodes between which the discharge takes place during operation. The electrodes are connected to a vacuum-tight current supply element which is led out from the envelope. At least one of the electrodes and, generally, both electrodes consists of a support of a high-melting metal, in most cases mainly tungsten or sometimes molybdenum or tantalum. The electrode is provided with an emissive material which, in accordance with the invention mainly consists of one or more oxidic compounds comprising tungsten and/or molybdenum oxide, alkaline earth metal oxide and rare earth metal oxide in the quantities indicated above. Besides the said oxidic compound or compounds the emitter may also contain small quantities of other substances, for example up till 5 mol.% of $SiO_2$ and up till 5 mol.% of one or more of the metals Zr, Ti and Al as such or as the oxides of these metals. Furthermore the emitter may contain up to approximately 10 mol.% of metallic W and/or Mo. In this description and in the Claims the rare earths metals must be understood to mean yttrium and the elements having atomic numbers from 57 (lanthanum) to 71 (lutetium) inclusive.

Trials have proved that with an emissive material according to the invention, when used in high-pressure gas discharge lamps substantially the same favourable emission properties can be obtained as with the known alkaline earth tungstate- and thorium oxide-containing emitters. A great advantage of the emitters according to the invention is that they contain no radio-active substances so that all drawbacks connected with the use of such substances are avoided. It was found that the lamps according to the invention start well also in the dark, which was not to be expected in view of the absence of a radio-active substance in the emitter.

The alkaline earth metal oxide and the tungstate and/or molybdenum oxide is present in the emitter according to the invention, at least for the main part, as one or more of the oxidic compounds $Me_3(W, Mo)O_6$, where Me represents the alkaline earth metals barium, calcium and strontium and where at least 25 mol.% of Me is barium. It is assumed that the rare earth metal oxide is present as such or as an oxidic compound in the emitter according to the invention.

Preference is given to lamps according to the invention having an emissive material which contains at least one of the oxides of yttrium, cerium and lanthanum, and in which the alkaline earth metal oxide is present in a quantity of 1.5 to 3 mole per mole of the rare earth metal oxide. With these compositions very good emission properties and a great durability of the emitter at operating conditions in the lamp are obtained.

The best results are obtained with an emissive material containing yttrium oxide and in which the alkaline earth metal oxide (in a quantity of 1.5 to 3 mole per mole of $Y_2O_3$) consists of substantially equimolar quantities of BaO on the one hand and SrO and/or CaO on the other hand.

An embodiment of a lamp according to the invention, which is preferred, is a high-pressure mercury vapour discharge lamp in which the ionizable medium contains mercury and a rare gas. In these lamps the electrodes are loaded relatively high and the present emissive material appear to give entire satisfaction.

A further preferred embodiment of the lamp according to the invention which also has electrodes which are highly loaded during operation, is a high-pressure sodium vapour discharge lamp in which the ionizable medium contains sodium, mercury and a rare gas.

The emissive materials for the lamps according to the invention can be obtained in different manners. It is, for example, possible to form the emitter by means of a solid state reaction at a high temperature of a mixture of starting materials. In a very advantageous method for producing a high-pressure gas discharge lamp an electrode support of tungsten is provided with a suspension which contains the basic materials for the electron-emitting material, whereafter the electrode is subjected to a heat treatment and the electrode support is applied within a lamp envelope and the lamp envelope is provided with an ionizable medium. In accordance with the invention a suspension is here used which contains as basic materials 20 to 60 mol.% of at least one of the rare earth metal oxides, 40 to 80 mol.% of alkaline earth metal carbonate, at least 25 mol.% of the carbonate being barium carbonate, and 0 to 10 mol.% of tungsten and the electrode support is heated in an inert or reducing atmosphere at a temperature of 1500° to 2100° C.

The suspension of basic materials (for example in butylacetate in which nitrocellulose has been dissolved as a binder) need not contain tungsten in this preferred method. The tungsten required for the formation of tungstate is in this method completely or partly supplied by the electrode support during the heat treatment. In the manner described above the electrode can be entirely finished and thereafter applied within the lamp envelope. It is also possible to provide the electrode support with the said suspension whereafter the electrode is built-in within the lamp envelope, the heat treatment of the electrode taking place within the lamp.

The invention will now be further explained with reference to a drawing and a number of measurements.

In the drawing

Figure 1:
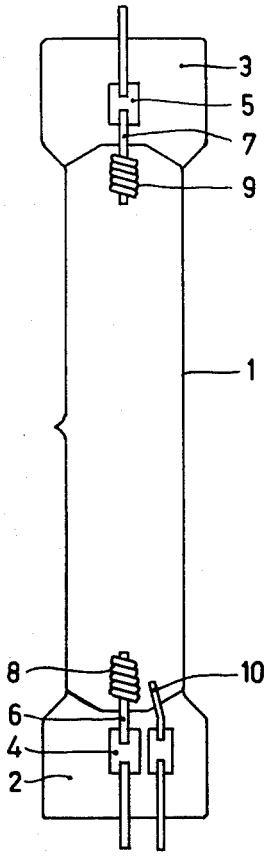
FIG. 1 shows diagrammatically a high-pressure mercury vapour discharge lamp according to the invention.

The high-pressure mercury vapour discharge lamp of FIG. 1 has a quartz glass envelope 1, which is closed at both ends by the pinches 2 and 3. The current supply conductors 6 and 7, consisting of tungsten are led vacuum-tight into the envelope 1 by means of molybdenum foils 4 and 5. Electrode supports 8 and 9 respectively are fitted to the current supply conductors 6 and 7. These electrode supports consist of a double tungsten coil. The electrode supports are provided with an electron emitting material according to the invention (not shown in this Figure). Within the envelope 1 an ionizable medium is provided, consisting of mercury and a small quantity of one or more rare gases as a starting gas. At the electrode 8 an auxiliary electrode 10 is provided, which consists of a tungsten wire which is also led out vacuum-tight by means of a molybdenum foil. Outside the lamp the auxiliary electrode 10 is electrically connected to the electrode 9 (not shown in the drawing) via a resistor. In most cases the lamp shown in FIG. 1 is used in an outer bulb whose interior wall may have been provided with a luminescent coating.

Figure 2:
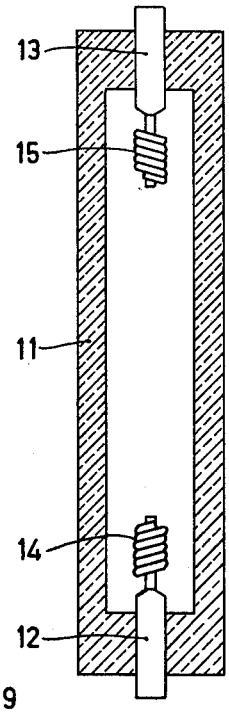
FIG. 2 is a cross-sectional view of a high-pressure sodium vapour discharge lamp according to the invention.

FIG. 2 shows a high-pressure sodium vapour discharge lamp according to the invention having an envelope 11 of densely sintered aluminium oxide. Niobium tubes 12 and 13, which are sealed vacuum-tight by means of a sealing glass into end parts of the envelope 11, serve as current supply conductors for the electrode supports 14 and 15. These electrode supports consist of tungsten coils and are provided with an electron emitting material according to the invention. The supports 14 and 15 are fitted to tungsten pins which in their turn are connected to the tubes 12 and 13. As an ionizable medium mercury and sodium and also a small quantity of rare gas is present within the envelope 11 as a starting gas. In practice also this lamp is usually positioned in an outer bulb (not shown in the drawing).

Figure 3:
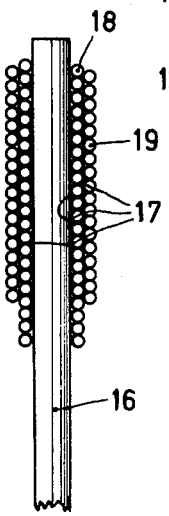
FIG. 3 shows, at an enlarged scale, a cross-section of the electrode of the lamp of FIG. 1.

FIG. 3 shows a cross-section of the electrodes 8 and 9 of FIG. 1. Reference 16 indicates the current supply conductor. The electrode support is a double coil consisting of a forward winding 18 which passes into a return winding 19. The emitter 17 is mainly positioned in the space between supply conductor 16 and winding 18 and between the teo windings 18 and 19.

EXAMPLE I

Ten high-pressure mercury vapour discharge lamps of the kind described with reference to FIG. 1 and suitable for an input of 400 W during operation, were produced. The electrodes of these lamps, consisting of spiralized tungsten electrode supports secured to tungsten current supply conductors were provided with the basic materials for an electron emitting material according to the invention. This was done with the aid of a suspension of $Y_2O_3$, $BaCO_3$ and $CaCO_3$ in the molar ratio 1 : 1 : 1 in a suspension medium consisting of butylacetate in which a small quantity of nitrocellulose had been dissolved. The electrode supports were immersed in this suspension and, after drying, superfluous material was brushed from the outer surface. Thereafter the electrodes were heated in a reducing atmosphere to 1800° C at which the emitter material is formed. The electrodes thus obtained were disposed in the lamp envelopes and the lamps were finished thereafter in the usual manner. Five of these lamps were placed in clear glass outer bulbs. The other five lamps were fitted each into a glass outer bulb which was coated at the inside with a red luminescent coating (europium-activated yttrium vanadate phosphate borate). Table I shows measurements at these lamps in operation during the first part of their life (up to 4000 burning hours). Indicated in the Table are the ignition voltage ($V_{ign}$) in volts, the luminous flux (L) in Lm/W and the lamp voltage ($V_{la}$) in volts at various instants during the life, column Ia (clear) for the lamps without luminescent coating and column Ib (coated) for the lamps having a luminescent coating. The measuring values stated are averages for five lamps. The Table also shows, for comparison, the measuring values of reference lamps under the heading Ref (clear) and Ref (coated). The reference lamps have been manufactured in the same manner as lamps according to the invention, however, with the proviso that a known suspension of starting materials was used for the emitter, containing $ThO_2$, $BaCO_3$ and $CaCO_3$ in a molar ratio of 1 : 1 : 1.

EXAMPLE II

In an analogous manner as described in Example I, five high-pressure mercury vapour discharge lamps were produced, now, however, of the 125 W type. Furthermore a suspension of starting materials was used for the emitters containing $Y_2O_3$, $BaCO_3$ and $CaCO_3$ in a molar ratio of 1 : 2 : 2. The lamps were placed in an outer bulb coated with a luminescent substance. Measurements at these lamps at various instants during the first part of the life are summarized (average value of five lamps) in Table II under II (coated). For comparison, the measuring data of lamps which have been obtained with the known emitter suspension indicated in Example I are again shown under the heading Ref (coated) which lamps are for the rest entirely equal to the lamps according to the invention.

EXAMPLE III

In an analogous manner as described in Example I five lamps were produced, again of the 125 W type. The suspension of basic materials for the emitter contained for these lamps $Y_{1.9}Eu_{0.1}O_3$, $BaCO_3$ and $CaCO_3$ in a molar ratio of 1 : 1 : 1.

The lamps were placed in a clear outer bulb. Measurements at these lamps are shown in Table II under the heading III (clear). Measurements to reference lamps (equal to the lamps according to the invention but with the known emitter are shown under the heading Ref (clear).

TABLE I

| Burning hours | measurement | Ia. clear | Ib. coated | Ref clear | Ref coated |
|---|---|---|---|---|---|
| 0 | $V_{ign}$ (V) | 127 | 132 | 130 | 130 |
| | L (Lm/W) | 53.6 | 59.4 | 54.1 | 59.4 |
| | $V_{la}$ (V) | 137 | 137 | 135 | 135 |
| 100 | $V_{ign}$ (V) | 132 | 132 | 132 | 137 |
| | L (Lm/W) | 53.2 | 57.2 | 53.4 | 57.5 |
| | $V_{la}$ (V) | 139 | 138 | 139 | 138 |
| 1000 | $V_{ign}$ (V) | 133 | 135 | 138 | 137 |
| | L (Lm/W) | 52.0 | 54.1 | 52.1 | 54.1 |
| | $V_{la}$ (V) | 139 | 139 | 140 | 138 |
| 4000 | $V_{ign}$ (V) | 140 | 143 | 147 | 148 |
| | L (Lm/W) | 50.6 | 51.3 | 51.1 | 50.0 |
| | $V_{la}$ (V) | 139 | 140 | 137 | 140 |

TABLE II

| Burning hours | measurement | II coated | Ref. coated | III clear | Ref clear |
|---|---|---|---|---|---|
| 100 | $V_{ign}$ (V) | 127 | 137 | 132 | 137 |
| | L (Lm/W) | 49.6 | 49.0 | 45.4 | 44.1 |
| | $V_{la}$ (V) | 120 | 121 | 116 | 122 |
| 1000 | $V_{ign}$ (V) | 133 | 147 | 137 | 143 |
| | L (Lm/W) | 45.6 | 47.2 | 44.0 | 43.5 |
| | $V_{la}$ (V) | 118 | 122 | 114 | 124 |
| 3000 | $V_{ign}$ (V) | 137 | 145 | 147 | 147 |
| | L (Lm/W) | 44.2 | 46.1 | 41.5 | 43.4 |
| | $V_{la}$ (V) | 118 | 121 | 117 | 122 |

What is claimed is:

1. A high-pressure gas discharge lamp having a radiation transmissive envelope containing electrodes and an ionizable medium in which the discharge is maintained, at least one of the electrodes consisting of a support of a high-melting metal provided with an electron emissive material which contains an alkaline earth metal and at least one of the metals tungsten and molybdenum, characterized in that the electron emissive material mainly consists of at least one oxidic compound containing at least one of the rare earth metal oxides, alkaline earth metal oxide in a quantity of 0.66 to 4 mole per mole of rare earth metal oxide and at least one of the oxides of tungsten and molybdenum in a quantity of 0.25 to 0.40 mole per mole of alkaline earth metal oxide, the alkaline earth metal oxide consisting of at least 25 mol.% of barium oxide.

2. A high-pressure gas discharge lamp as claimed in claim 1, characterized in that said emissive material contains at least one of the oxides of yttrium, cerium and lanthanum and alkaline earth metal oxide in a quantity of 1.5 to 3 mole per mole of rare earth metal oxide.

3. A high-pressure discharge lamp as claimed in claim 1 in which said ionizable medium contains mercury and a rare gas.

4. A high-pressure discharge lamp as claimed in claim 1 in which said ionizable medium contains sodium, mercury and a rare gas.

5. A high-pressure gas discharge lamp as claimed in claim 2, characterized in that said emissive material contains yttrium oxide and barium oxide and a material selected from the group consisting of strontium oxide and calcium oxide in a quantity equimolar to the quantity of barium oxide.

6. A method for producing a gas discharge lamp which comprises: providing a tungsten electrode support; providing a suspension on said support which contains 20 to 60 mol.% of at least one of the rare earth metal oxides, 40 to 80 mol.% of alkaline earth metal carbonate, in which at least 25 mol.% of the carbonate is barium carbonate and 0 to 10 mol.% of tungsten; subjecting said support and suspension to a heat treatment at a temperature of 1500° to 2100° C in an inert or reducing atmosphere; and then positioning said electrode support within a lamp envelope; and then providing an ionizable medium within said lamp envelope.

7. A method for producing a gas discharge lamp which comprises: providing a tungsten electrode support; providing a suspension on said support which contains 20 to 60 mol.% of at least one of the rare earth metal oxides, 40 to 80 mol.% of alkaline earth metal carbonate, in which at least 25 mol.% of the carbonate is barium carbonate and 0 to 10 mol.% of tungsten; positioning said electrode support within a lamp envelope; subjecting said support and suspension to a heat treatment at a temperature of 1500° to 2100° C in an inert or reducing atmosphere; and then providing an ionizable medium within said lamp envelope.

* * * * *